US009357304B2

(12) United States Patent
Christoph

(10) Patent No.: US 9,357,304 B2
(45) Date of Patent: May 31, 2016

(54) SOUND SYSTEM FOR ESTABLISHING A SOUND ZONE

(71) Applicant: Harman Becker Automotive Systems GmbH, Karlsbad, DE (US)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 84 days.

(21) Appl. No.: 14/286,007

(22) Filed: May 23, 2014

(65) Prior Publication Data

US 2014/0348353 A1 Nov. 27, 2014

(30) Foreign Application Priority Data

May 24, 2013 (EP) ..... 13169203

(51) Int. Cl.

| | |
|---|---|
| ***H04R 5/02*** | (2006.01) |
| ***H04R 3/12*** | (2006.01) |
| ***H04S 7/00*** | (2006.01) |
| *H04S 1/00* | (2006.01) |
| *H04S 3/00* | (2006.01) |

(52) U.S. Cl.

CPC .. *H04R 3/12* (2013.01); *H04S 1/00* (2013.01); *H04S 7/301* (2013.01); *H04R 2499/13* (2013.01); *H04S 1/007* (2013.01); *H04S 3/008* (2013.01); *H04S 2400/09* (2013.01); *H04S 2420/01* (2013.01)

(58) Field of Classification Search

CPC ..... H04R 5/02; H04S 7/301
USPC ..... 381/303
See application file for complete search history.

(56) References Cited

U.S. PATENT DOCUMENTS

| | | | | |
|---|---|---|---|---|
| 5,889,867 | A | 3/1999 | Bauck | |
| 6,243,476 | B1 * | 6/2001 | Gardner | H04S 1/007 381/1 |
| 9,107,021 | B2 * | 8/2015 | Florencio | H04S 1/007 |
| 2010/0202629 | A1 * | 8/2010 | Takeuchi | H04S 5/00 381/98 |
| 2010/0305725 | A1 | 12/2010 | Brannmark et al. | |
| 2013/0223658 | A1 * | 8/2013 | Betlehem | H04S 3/002 381/307 |

OTHER PUBLICATIONS

Cooper et al., "Prospects for Transaural Recording", J. Audio Eng. Soc., vol. 37, No. 1/2, Jan./Feb. 1989, pp. 3-19.

(Continued)

*Primary Examiner* — Simon King
(74) *Attorney, Agent, or Firm* — Brooks Kushman P.C.

(57) ABSTRACT

A system and method for acoustically reproducing at least two electrical audio signals and establishing at least two sound zones that are represented by individual patterns of reception sound signals includes processing the at least two electrical audio signals to provide processed electrical audio signals; converting the processed electrical audio signals into corresponding acoustic audio signals with at least two loudspeakers that are arranged at positions separate from each other; transferring each of the acoustic audio signals according to a transfer matrix from each of the loudspeakers to each of the sound zones where they contribute to the reception sound signals; and processing of the at least two electrical audio signals comprises inverse filtering according to a filter matrix. Inverse filtering is configured to compensate for the room transfer matrix so that each one of the reception sound signals corresponds to one of the electrical audio signals.

20 Claims, 10 Drawing Sheets

(56) References Cited

OTHER PUBLICATIONS

Kim, "Authentic Reproduction of Stereo Sound—A Wiener Filter Approach", Audio Engineering Society, Paper 5951, Oct. 10-13, 2003, New York, NY, pp. 1-8.
Kirkeby et al., "Fast Deconvolution of Multichannel Systems Using Regularization", IEEE Transactions on Speech and Audio Processing, vol. 6, No. 2, Mar. 1998, pp. 189-195.
Neely et al., "Invertibility of a Room Impulse Response", J. Acoust. Soc. Am., vol. 66, No. 1, Jul. 1979, pp. 165-169.
Takeuchi et al., "Subjective and Objective Evaluation of the Optimal Source Distribution for Virtual Acoustic Imaging", J. Audio Eng. Soc., vol. 55, No. 11, Nov. 2007, pp. 981-997.
Parodi et al., "Objective Evaluation of the Sweet Spot Size in Spatial Sound Reproduction Using Elevated Loudspeakers", J. Acoust. Soc. Am., vol. 128, No. 3, Sep. 2010, pp. 1045-1055.
Gupta et al., "Three Dimensional Sound Field Reproduction Using Multiple Circular Loudspeaker Arrays", IEEE Tran. Audio, Speech & Language Processing, 2010, pp. 1-11.
Hess, "Digitale Filter", Teubner Studienbucher, Elektrotechnik, 1989, 195 pages.
Papadopoulos et al., "Choice of Inverse Filter Design Parameters in Virtual Acoustic Imaging Systems", J. Audio Eng. Soc., vol. 58, No. 1/2, Jan./Feb. 2010, pp. 22-35.
Tan et al., "Elevated Speakers Image Correction Using 3D Audio Processing", Audio Engineering Society, Sep. 22-25, 2000, 16 pages.
European Search Report for corresponding Application No. EP 13169203.0, mailed Aug. 23, 2013, 10 pages.
Farina et al, "Ambiophonic Principles for the Recording and Reproduction of Surround Sound for Music", AES 19th International Conference, Jun. 1, 2001, 21 pages.

* cited by examiner

SOUND SYSTEM FOR ESTABLISHING A SOUND ZONE

CROSS-REFERENCE TO RELATED APPLICATIONS

This application claims priority to EP Application No. 13 169 203.0 filed on May 24, 2013, the disclosure of which is incorporated in its entirety by reference herein.

TECHNICAL FIELD

The disclosure relates to a system and method (generally referred to as a "system") for processing a signal.

BACKGROUND

Spatially limited regions inside a space typically serve various purposes regarding sound reproduction. A field of interest in the audio industry is the ability to reproduce multiple regions of different sound material simultaneously inside an open room. This is desired to be obtained without the use of physical separation or the use of headphones, and is herein referred to as "establishing sound zones". A sound zone is a room or area in which sound is distributed. More specifically, arrays of loudspeakers with adequate preprocessing of the audio signals to be reproduced are of concern, in which different sound material is reproduced in predefined zones without interfering signals from adjacent ones. In order to realize sound zones, it is necessary to adjust the response of multiple sound sources to approximate the desired sound field in the reproduction region. A large variety of concepts concerning sound field control, have been published, with different degrees of applicability to the generation of sound zones.

SUMMARY

A sound system for acoustically reproducing at least two electrical audio signals and establishing at least two sound zones that are represented by individual patterns of reception sound signals includes a signal processing arrangement and at least two loudspeakers. The signal processing arrangement is configured to process the at least two electrical audio signals to provide processed electrical audio signals. The at least two loudspeakers are arranged at positions separate from each other, each configured to convert the processed electrical audio signals into corresponding acoustic audio signals. Each of the acoustic audio signals is transferred according to a transfer matrix from each of the loudspeakers to each of the sound zones where they contribute to the two reception sound signals. Processing of the at least two electrical audio signals includes inverse filtering according to a filter matrix. Inverse filtering is configured to compensate for the room transfer matrix so that each one of the reception sound signals corresponds to one of the electrical audio signals.

A method for acoustically reproducing at least two electrical audio signals and establishing at least two sound zones that are represented by individual patterns of reception sound signals. The method includes processing the at least two electrical audio signals to provide processed electrical audio signals and converting the processed electrical audio signals into corresponding acoustic audio signals with at least two loudspeakers that are arranged at positions separate from each other. The method further includes transferring each of the acoustic audio signals according to a transfer matrix from each of the loudspeakers to each of the sound zones where they contribute to the reception sound signals; and processing of the at least two electrical audio signals includes inverse filtering according to a filter matrix. Inverse filtering is configured to compensate for the room transfer matrix so that each one of the reception sound signals corresponds to one of the electrical audio signals.

Other systems, methods, features and advantages will be, or will become, apparent to one with skill in the art upon examination of the following figures and detailed description. It is intended that all such additional systems, methods, features and advantages be included within this description, be within the scope of the invention and be protected by the following claims.

BRIEF DESCRIPTION OF THE DRAWINGS

The system may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
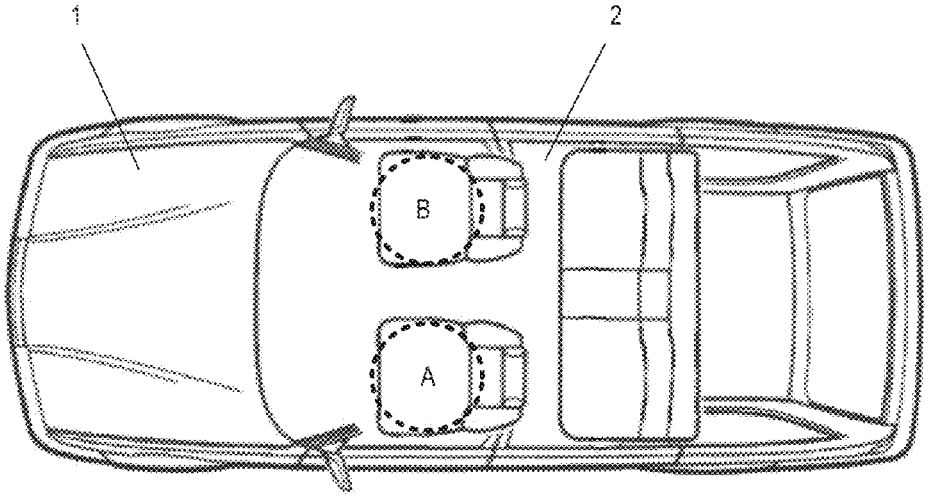
FIG. 1 is a top view of a car cabin with individual sound zones.

Referring to FIG. 1, individual sound zones in an enclosure such as cabin 2 of car 1 are shown which include in particular three different zones A and B. In zone A, sound program A is reproduced and in zone B sound program B is reproduced. The spatial orientation of the two zones is not fixed. This should adapt to user location and should ideally be able to track the exact position as well as reproduce the desired sound program in the spatial region of concern.

Certain aspects of an ideal system must be reformulated and delimited in order to obtain the basis for a practical system. For example, a complete separation of the sound fields found in each of the two zones (A and B) is not a realizable condition for a practical system implemented under reverberant conditions. Thus, it is to be expected that the users are subjected to a certain degree of annoyance that is created by adjacent reproduced sound fields.

Figure 2:
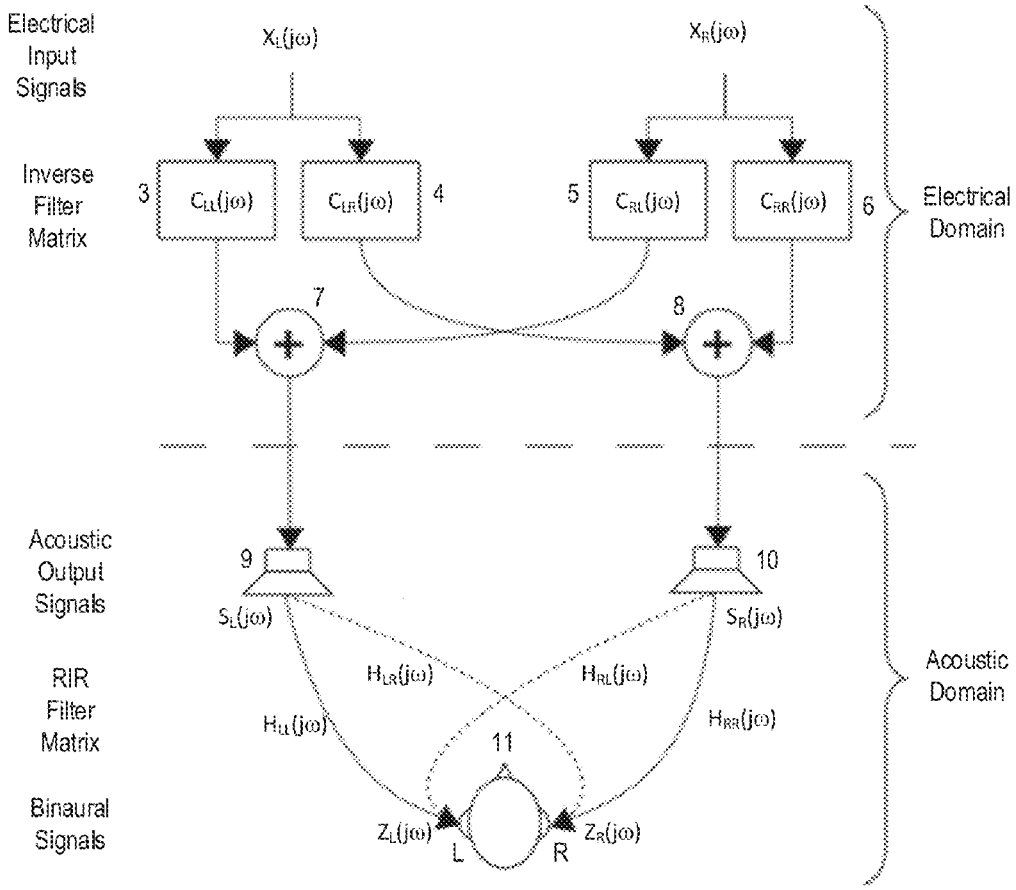
FIG. 2 is a schematic diagram illustrating a 2×2 transaural stereo system.

FIG. 2 illustrates a two-zone transaural stereo system, i.e., a 2×2 system in which the receiving signals are binaural (stereo), for example, picked up by two microphones arranged on an artificial head. The two zones L, R of the transaural stereo system of FIG. 2 are established around a listener 11 based on input electrical stereo audio signals XL(jω) and XR(jω) by way of two loudspeakers 9 and 10 in connection with an inverse filter matrix with four inverse filters 3-6 that have transfer functions CLL(jω), CLR(jω), CRL(jω) and CRR(jω) and that are connected upstream of the two loudspeakers 9 and 10. The signals and transfer functions are frequency domain signals and functions that correspond with time domain signals and functions. The left electrical input (audio) signal XL(jω) and the right electrical input (audio) signal XR(jω), which may be provided by any suitable audio signal source, such as a radio receiver, music player, telephone, navigation system or the like, are pre-filtered by the inverse filters 3-6. Filters 3 and 4 filter signal XL(jω) with transfer functions CLL(jω) and CLR(jω), and filters 5 and 6 filter signal XR(jω) with transfer functions CRL(jω) and CRR(jω) to provide inverse filter output signals. The inverse filter output signals provided by filters 3 and 5 are combined by adder 7, and the inverse filter output signals provided by filters 4 and 6 are combined by adder 8 to form combined signals SL(jω) and SR(jω), respectively. In particular, signal SL(jω) supplied to the left loudspeaker 9 can be expressed as:

$$S_L(j\omega)=C_{LL}(j\omega)\cdot X_L(j\omega)+C_{RL}(j\omega)\cdot X_R(j\omega), \tag{1}$$

and signal $S_R(j\omega)$ supplied to the right loudspeaker 10 can be expressed as:

$$S_R(j\omega)=C_{LR}(j\omega)\cdot X_L(j\omega)+C_{RR}(j\omega)\cdot X_R(j\omega). \tag{2}$$

Loudspeakers 9 and 10 radiate the acoustic loudspeaker output signals $S_L(j\omega)$ and $S_R(j\omega)$ to be received by the left and right ears of the listener, respectively. The sound signals actually present at listener's 11 left and right ears are denoted as $Z_L(j\omega)$ and $Z_R(j\omega)$, respectively in which:

$$Z_L(j\omega)=H_{LL}(j\omega)\cdot S_L(j\omega)+H_{RL}(j\omega)\cdot S_R(j\omega) \text{ and} \tag{3}$$

$$Z_R(j\omega)=H_{LR}(j\omega)\cdot S_L(j\omega)+H_{RR}(j\omega)\cdot S_R(j\omega). \tag{4}$$

In equations 3 and 4, the transfer functions Hij(jω) denote the room impulse response (RIR) in the frequency domain, i.e., the transfer functions from loudspeakers 9 and 10 to the left and right ears of the listener, respectively. Indices i and j may be "L" and "R" and refer to the left and right loudspeaker (index "i") and the left and right ear (index "j"), respectively.

The above equations 1-4 may be rewritten in matrix form, wherein equations 1 and 2 may be combined into:

$$S(j\omega)=C(j\omega)\cdot X(j\omega) \tag{5}$$

and equations 3 and 4 may be combined into:

$$Z(j\omega)=H(j\omega)\cdot S(j\omega), \tag{6}$$

wherein X(jω) is a vector composed of the electrical input signals, i.e., $X(j\omega)=[X_L(j\omega), X_L(j\omega)]^T$ S(jω) is a vector composed of the loudspeaker signals, i.e., $S(j\omega)=[S_L(j\omega), S_L(j\omega)]^T$, C(jω) is a matrix representing the four filter transfer functions $C_{LL})j\omega)$, $C_{RL}(j\omega)$, $C_{LR}(j\omega)$, and $C_{RR}(j\omega)$, and H(jω) is a matrix representing the four room impulse responses in the frequency domain $H_{LL}(j\omega)$, $H_{RL}(j\omega)$, $H_{LR}(j\omega)$, and $H_{RR}(j\omega)$. Combining equations 5 and 6 yields:

$$Z(j\omega)=H(j\omega)\cdot C(j\omega)\cdot X(j\omega). \tag{6}$$

From the above equation 6 it can be seen that when $$C(j\omega)=H^{-1}(j\omega)\cdot e^{-j\omega\tau}, \tag{7}$$

i.e., the filter matrix C(jω) is equal to the inverse of the matrix H(jω) of room impulse responses in the frequency domain $H^{-1}(j\omega)$ plus an additional delay τ (compensating at least for the acoustic delays), then the signal $Z_L(j\omega)$ arriving at the left ear of the listener is equal to the left input signal $X_L(j\omega)$ and the signal $Z_R(j\omega)$ arriving at the right ear of the listener is equal to the right input signal $X_R(j\omega)$, wherein the signals $Z_L(j\omega)$ and $Z_R(j\omega)$ are delayed as compared to the input signals $X_L(j\omega)$ and $X_R(j\omega)$, respectively. That is:

$$Z(j\omega)=X(j\omega)\cdot e^{-j\omega\tau}. \tag{8}$$

As can be seen from equation 7 designing a transaural stereo reproduction system includes theoretically inverting the transfer function matrix H(jω), which represents the room impulse responses, i.e., the RIR matrix in the frequency domain. For example, the inverse may be determined as follows:

$$C(j\omega)=det(H)^{-1}\cdot adj(H(j\omega)), \tag{9}$$

which is a consequence of Cramer's rule applied to equation 7 (the delay is neglected in equation 9). The expression adj (H(jω)) represents the adjugate matrix of the matrix H(jω). One can see that the pre-filtering may be done in two stages, wherein the filter transfer function adj(H(jω)) ensures a damping of the cross-talk and the filter transfer function det $(H)^{-1}$ compensates for the linear distortions caused by the transfer function adj (H(jω)). The adjugate matrix adj (H(jω)) always results in a causal filter transfer function, whereas the compensation filter with the transfer function G(jω))=det $(H)^{-1}$ may be more difficult to design.

In the example of FIG. 2, the left ear (signal $Z_L$) may be regarded as being located in a first sound zone and the right ear (signal $Z_R$) may be regarded as being located in a second sound zone. This system may provide a sufficient cross-talk damping so that, substantially, the input signal $X_L$ is reproduced only in the first sound zone (left ear) and the input signal $X_R$ is reproduced only in the second sound zone (right ear). As a sound zone is not necessarily associated with a listener's ear, this concept may be generalized and extended to a multi-dimensional system with more than two sound zones provided that the system comprises as many loudspeakers as individual sound zones.

Figure 3:
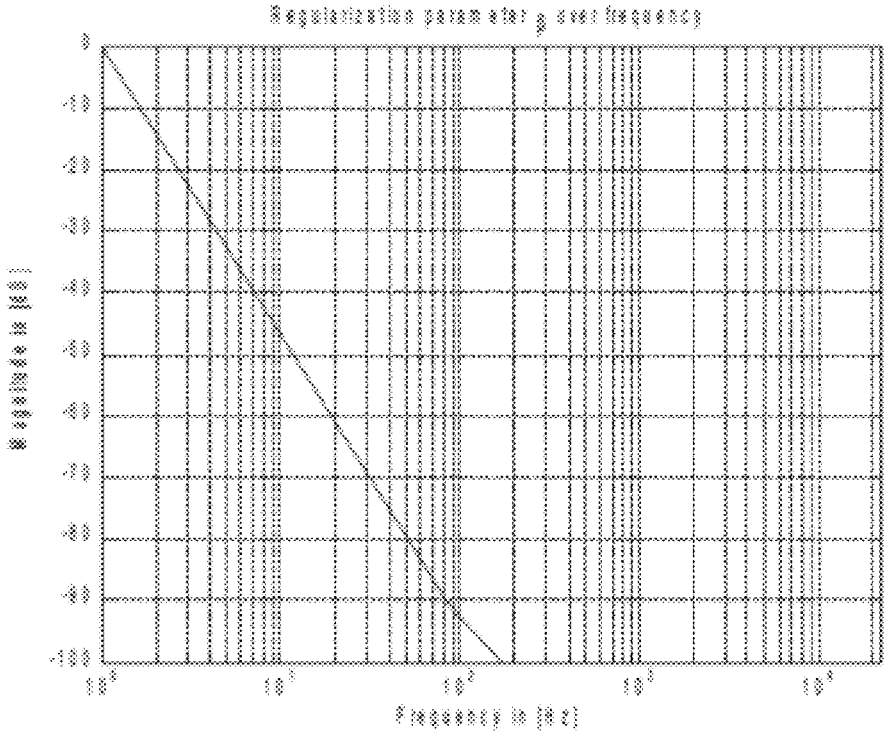
FIG. 3 is a diagram illustrating the magnitude frequency relation of a regularization parameter applicable in the system of FIG. 2.

Referring again to the car cabin shown in FIG. 1, two sound zones are associated with the front seats of the car. Sound zone A is associated with the driver's seat and sound zone B is associated with the front passenger's seat. When using four loudspeakers as shown in the example of FIG. 3, equations 6-9 are still valid but yield a fourth order system instead of a second order system as in the example of FIG. 2. The inverse filter matrix C(jω) and the RIR matrix H(jω) are then a 4×4 matrix.

As already outlined above, it is very difficult to implement a satisfying compensation filter (transfer function matrix $G(j\omega)=\det(H)^{-1}=1/\det\{H(j\omega)\}$) of reasonable complexity. One approach is to employ regularization in order not only to provide an improved inverse filter but also to provide maximum output power which is determined by a regularization parameter β(jω). Considering only one (loudspeaker-to-zone) channel, the related transfer function matrix $G(j\omega_k)$ reads as:

$$G(j\omega_k)=det\{H(j\omega_k)\}/(det\{H(j\omega_k)\}^*det\{H(j\omega_k)\}+\beta)\ j\omega_k)), \tag{10}$$

in which $\det\{H(j\omega_k)\}=H_{LL}(j\omega_k)H_{RR}(j\omega_k)-H_{LR}(j\omega_k)H_{RL}(j\omega_k)$ is the gram determinant of the matrix $H(j\omega_k)$, k=[0, . . . , N−1] is a discrete frequency index, $\omega_k=2\pi kf_s/N$ is the angular frequency at bin k, $f_s$ is the sampling frequency and N is the length of the fast Fourier transformation (FFT).

Figure 4:
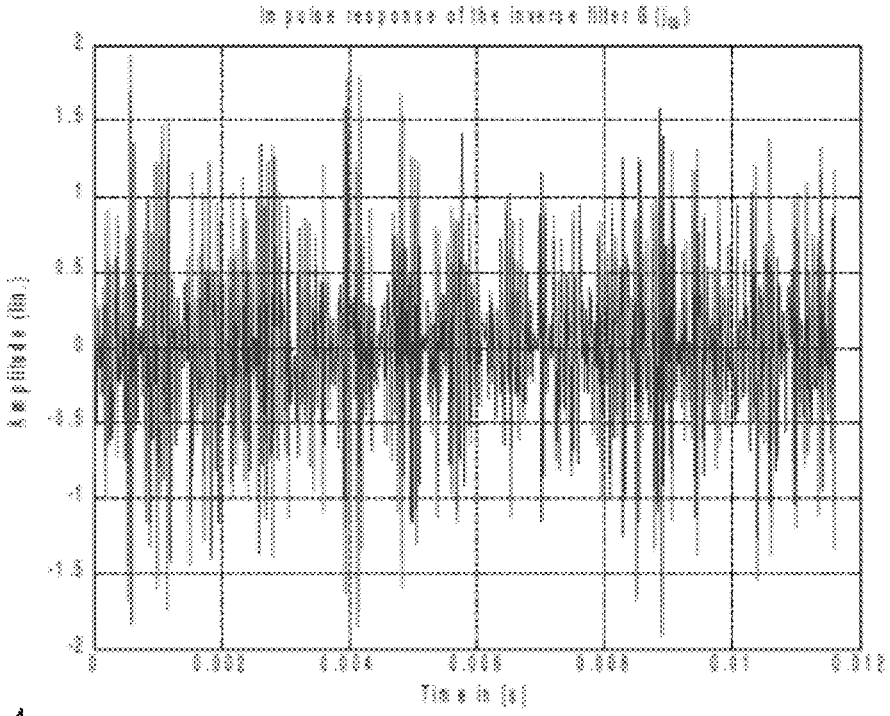
FIG. 4 is a diagram illustrating the impulse response of a compensation filter that has a spectrally regularized transfer function and is applicable in the system of FIG. 2.

Regularization has the effect that the compensation filter exhibits no ringing behavior caused by high-frequency, narrow-band accentuations in the compensation filter. For example, applying the regularization parameter β(jω) shown in FIG. 3 as magnitude over frequency, a compensation filter that has been limited to 512 taps at fs=44.1 kHz provides an impulse response as shown in FIG. 4. In this system, a channel has been employed that includes passively coupled midrange and high-range loudspeakers. Therefore, no regularization has been provided in the midrange and high-range parts of the spectrum. Only the lower spectral range, i.e., the range below corner frequency fc, which is determined by the harmonic distortion of the loudspeaker employed in this range, is regularized, i.e., limited in the signal level, which can be seen from the regularization parameter β(jω) that increases with decreasing frequency. This increase towards lower frequencies again corresponds to the characteristics of the (bass) loudspeaker used. The increase may be, for example, a 20 dB/decade path with common second-order loudspeaker systems. Bass reflex loudspeakers are commonly fourth-order systems so that the increase would be 40 dB/decade. Moreover, it can be seen from the diagram of FIG. 4 that a compensation filter designed according to equation 10 would cause timing problems which are experienced by a listener as acoustic artifacts.

The individual characteristic of the compensation filter's impulse response depicted in the diagram of FIG. 4 results from the attempt to complexly invert detH(jω), i.e., to invert magnitude and phase despite the fact that the transfer functions are commonly non-minimum phase functions. Simply speaking, the magnitude compensates for tonal aspects and the phase compresses the impulse response ideally to Dirac pulse size. It has been found that the tonal aspects are much more important in practical use than the perfect inversion of the phase provided the total impulse response keeps its minimum phase character in order to avoid any acoustic artifacts. In the compensation filters described below, only the minimum phase part of detH(jω), which is hMinϕ, has been inverted, along with some regularization as the case may be.

An exemplary method for determining the minimum phase part $h_{Min\phi}$ in an efficient and simple way is as follows:

$$h_{Min\varphi}\Re\{IFFT\{\exp\{FFT\{\mathrm{diag}(w)h_{ReCep}\}\}\}\}, \text{ whereby} \tag{11}$$

$$h_{ReCep}=\Re\{IFFT\{\ln\{|FFT\{h\}|\}\}\}, \text{ and} \tag{12}$$

$$w=\begin{cases}\left[\underbrace{1\ 2,\ldots,2,}_{\lceil\frac{n}{2}\rceil-1}\ 1,\ \underbrace{0,0,\ldots,0}_{\lceil\frac{n}{2}\rceil-1}\right]^T, & \text{if } N \text{ is even}\\ \left[\underbrace{1\ 2,\ldots,2,}_{\lceil\frac{n}{2}\rceil-1}\ 0,\ \underbrace{0,0,\ldots,0}_{\lceil\frac{n}{2}\rceil-1}\right]^T, & \text{if } N \text{ is odd,}\end{cases} \tag{13}$$

$h_{ReCeps}$ = column vector, which includes the $N$ values of the real cepstrum of $h$, $w$ = window function with length $N$, with which $h_{Min\varphi}$ is weighted, $h_{Min\varphi}$ = column vector, which includes the $N$ filter coefficients of the minimum phase part of $h$, $\lceil . \rceil$ = rounding the value up to the next integer value.

In order to reduce ringing, which is, although to much less degree, present in the minimum phase impulse response represented by vector $h_{Min\phi}$, the magnitude of the frequency response may be subject to regularization. Before regularization, for example, a psycho-acoustically motivated, non-linear smoothing may be performed which models the frequency selectivity of the human ear and which can be expressed as:

$$\overline{A}(j\omega_n)=\frac{1}{\min\left\{N-1,\left\lceil n\propto-\frac{1}{2}\right\rceil\right\}-\max\left\{0,\left\lceil\frac{n}{\propto}-\frac{1}{2}\right\rceil\right\}}\sum_{k=max\{0,\lceil\frac{n}{\propto}-\frac{1}{2}\rceil\}}^{min\{N-1,\lceil n\propto-\frac{1}{2}\rceil\}}|A(j\omega_k)|, \tag{14}$$

in which $n=[0,\ldots,N-1]$, i.e., the discrete frequency index of the equalized value, $\left\lceil x-\frac{1}{2}\right\rceil$ = rounding to the next integer value, $\alpha$ = smoothing coefficient, e.g., $\frac{\text{octave}}{3}\rightarrow\alpha=2^{\frac{1}{3}}$, $\overline{A}(j\omega_n)$ = smoothed value of $A(j\omega)$, $k$ = discrete frequency index of the non smoothed value, $k\in[0,\ldots N-1]$ Then, regularization as outlined above may start with regularization parameter β(jω), which limits the dynamics of the compensation filter (frequency function G(jω)). The inverse of the minimum phase part of det |H(jω)| can be calculated by using the impulse response of the minimum phase part of det |H(jω)|, i.e., the values of $h_{detMin\phi}$ that correspond to the coefficients of the numerator polynomial, as denominator polynomial. Accordingly, the impulse response $G_{Min\phi}(j\omega)$ of the inverse filter can be expressed as follows:, $$G_{Min\varphi}(j\omega)=\frac{1}{\det\{H_{Min\varphi}(j\omega)\}}. \tag{15}$$

Figure 5:
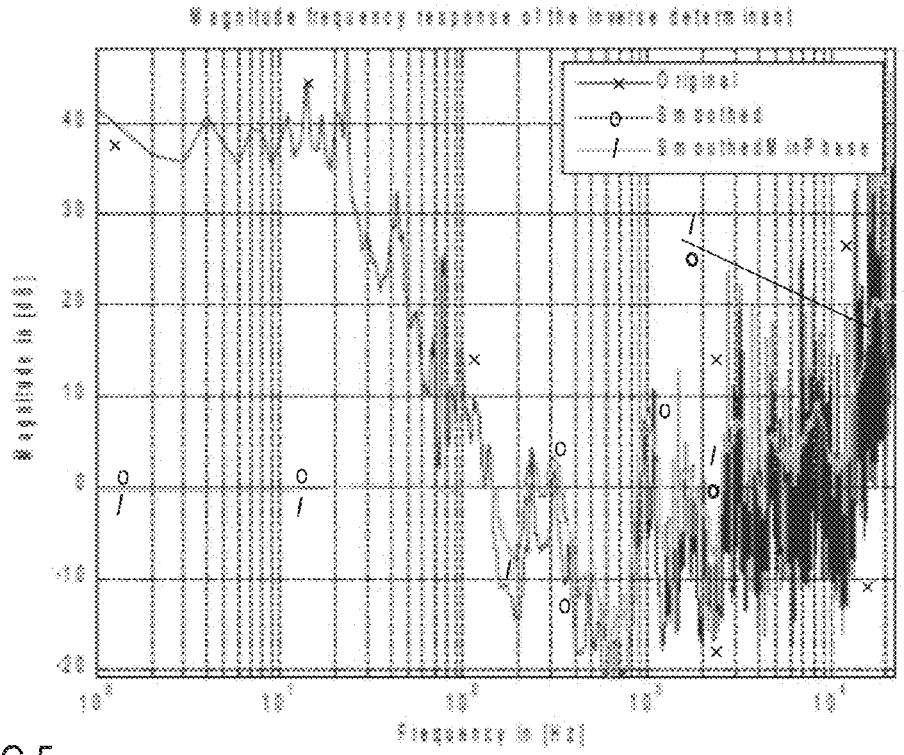
FIG. 5 is a diagram illustrating transfer functions before and after spectral regularization of the minimum phase part and smoothening.
Figure 6:
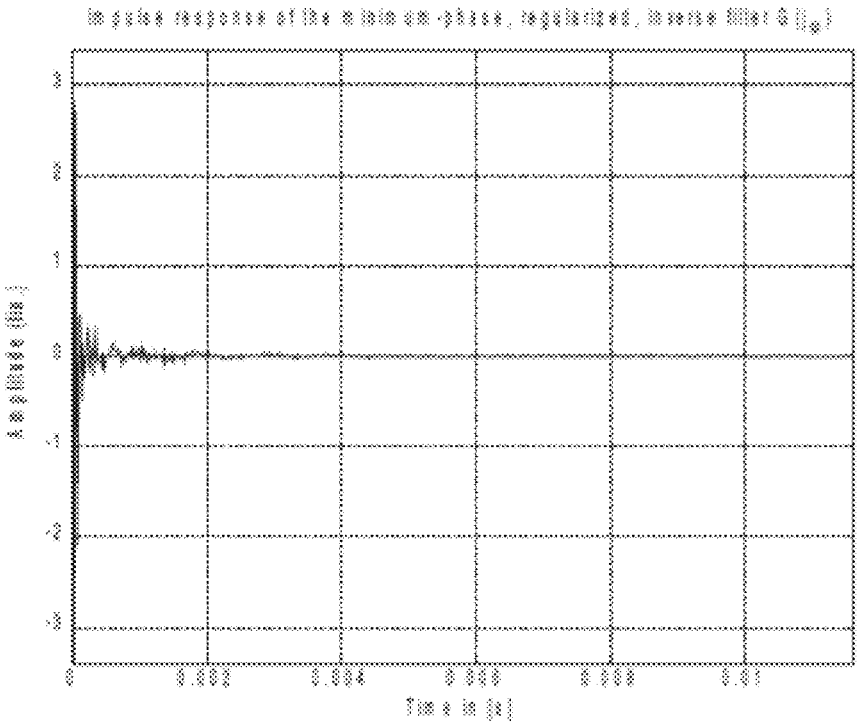
FIG. 6 is a diagram illustrating the impulse response of a regularized minimum phase compensation filter.

The corresponding magnitude frequency characteristic is depicted in FIG. 5 as original curve "x". The corresponding impulse response of the regularized minimum phase compensation filter of FIG. 5 is shown in FIG. 6. The regularized "smoothed" minimum phase magnitude frequency function ("/") as depicted in FIG. 5 can be derived as follows:

In the first step, the impulse response $G_{Min\phi}(j\omega)$ of the inverse filter is smoothed on the basis of smoothening coefficient $\alpha=2^{1/9}$, which is a ninth-octave smoothening, with the non-linear filter described above by way of equation (14) to provide a smoothed transfer function $\overline{G_{Min\phi}}(j\omega)$.

In the second step, the smoothed transfer function $\overline{G_{Min\phi}}(j\omega)$ is scaled to 0 dB at the maximum corner frequency $f_c$ of the channels/loudspeakers used, which may in the present example be $f_c$~150 Hz, according to:

$$\overline{G_{Min\varphi}}(j\omega_k) = \begin{cases} 0\text{ dB}, & \text{if } k < k_c = N\dfrac{f_C}{f_S} \\ \overline{G_{Min\varphi}}(j\omega_{kRefUp}), & \text{if } k \geq k_C = N\dfrac{f_C}{f_S} \end{cases} \tag{16}$$

In the third step, the upper point of intersection of the scaled transfer function $G_{Min\phi}(j\omega)$ curve and the 0 dB line is determined, and from this frequency on, which is referred to herein as $f_{RegUp}$, the value of smoothed transfer function $\overline{G_{Min\phi}}(j\omega)$ is maintained constantly according to:

$$\overline{G_{Min\varphi}}(j\omega_k) = \begin{cases} \overline{G_{Min\varphi}}(j\omega_k), & \text{if } k < k_{kRefUp} = N\dfrac{f_{RegUp}}{f_S} \\ \overline{G_{Min\varphi}}(j\omega_{kReUp}), & \text{if } k \geq k_{kRefUp} = N\dfrac{f_{RegUp}}{f_S} \end{cases}, \tag{17}$$

In the fourth step, a linear phase filter with transfer function $G_{RegLin\phi}(j\omega)$ that approximates the regularized magnitude frequency function $\overline{G_{Min\phi}}(j\omega)$ is used, which is derived by way of a frequency sampling technique and which can be described for type 1 and type 2 finite impulse response (FIR) filters as outlined below.

First, calculation of the magnitude frequency function of the impulse $|G_{RegOin\phi}(j\omega_n)|$ of the transfer function $G_{RegLin\phi}(j\omega_n)$ may be performed according to:

$$|G_{RegLin\varphi}(0)| = |\overline{G_{Min\varphi}}(0)| \tag{18}$$

$$|G_{RegLin\varphi}(j\omega_n)| = |\overline{G_{Min\varphi}}(j\omega_k)|, \tag{19}$$

für $$n = [1, \ldots, R-1]$$

und $$k = \left\lceil n\left(\frac{N-1}{R-1}\right) - \frac{1}{2}\right\rceil,$$

whereby N is the length of $|\overline{G_{Min\phi}}(j\omega_k)|$, which is the length of the first fast Fourier transformation (FFT) and R is the length of the linear phase FIR, which is the length of the second FFT.

Second, calculation of the phase characteristic may be performed according to:

$$\sphericalangle G_{RegLin\varphi}(j\omega_n) = -\left(\frac{R-2}{R-1}\right)\pi n, \tag{20}$$

with $$n = \left[0, \ldots, \left\lceil\left(\frac{R}{2}-1\right) - \frac{1}{2}\right\rceil\right],$$

$$\sphericalangle G_{RegLin\varphi}(j\omega_n) = \left(\frac{R-2}{R-1}\right)\pi((R-1)-n), \tag{21}$$

with $$n = \left[\left\lceil\left(\frac{R}{2}-1\right) + \frac{1}{2}\right\rceil, \ldots R-1\right],$$

wherein $\sphericalangle G_{RegLin\phi}(j\omega_n)$ is the linear phase frequency function of the transfer function $G_{RegLin\phi}(j\omega_n)$.

Third, the impulse response may be calculated according to:

$$g_{RegLin\phi}[n] = \Re\{FFT\{|G_{regLin\phi}(j\omega_n)|e^{\sphericalangle G_{RegLin\phi}(j\omega_n)}\}\}, n=[0, \ldots, R-1].$$

Finally, the minimum phase part of $g_{RegLin\phi}[n]$ having the length R/2 is calculated according to equations 11-13 and representing the regularized, minimum phase part of the compensation filter, which is referred to as $g_{Inv}[n]$. An impulse response of an exemplary compensation filter restricted to a length of 512 taps at a sampling frequency of $f_s$=44.1 kHz is shown in FIG. 6 and the corresponding magnitude frequency function based on a complete impulse response is shown as curve"/" (smoothed minimum phase) in FIG. 5. In FIG. 5, curve "o" depicts the smoothed function and curve "x" the original function.

Figure 7:
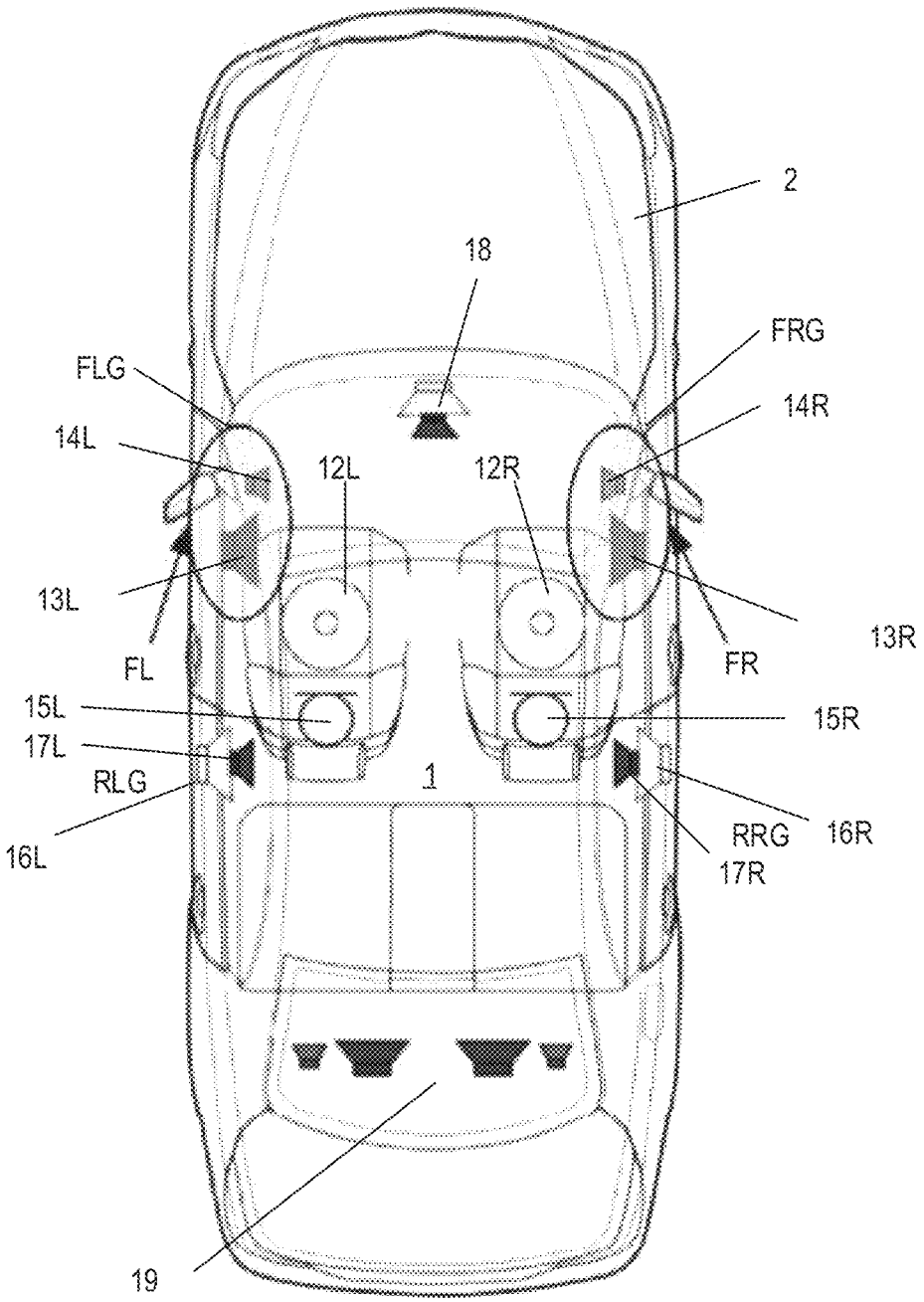
FIG. 7 is a top view of a car cabin equipped with loudspeakers and microphones in order to establish and measure individual sound zones.

Referring to FIG. 7, an exemplary 2×2 system may include two front channels, i.e., front left channel FL and front right channel FR, which include woofers 12L and 12R; midrange loudspeakers 13L and 13R and tweeters 14L and 14R, respectively. Woofers 12L and 12R are mounted under the left and right front seats, respectively. Midrange loudspeakers 13L and 13R and tweeters 14L and 14R are mounted in the left and right front side doors, respectively. For the sake of accurate measurements microphones 15L and 15R are mounted in a position where an average listener would rest his/her head.

Figure 8:
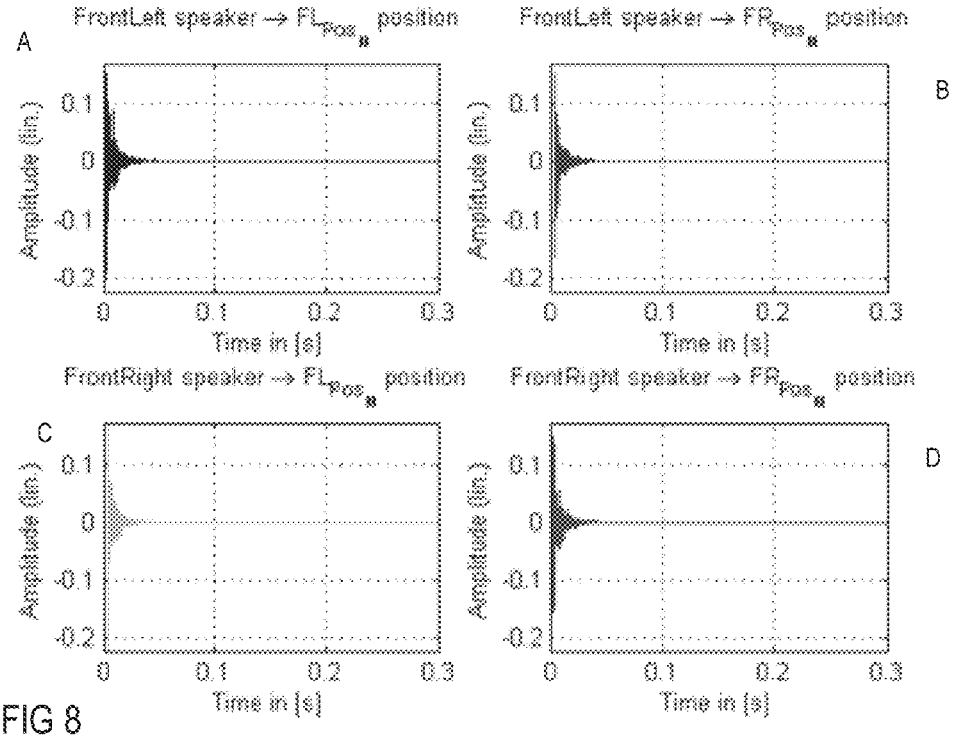
FIG. 8 is a diagram illustrating the impulse response of the channels of an RIR matrix with no filtering applied.
Figure 9:
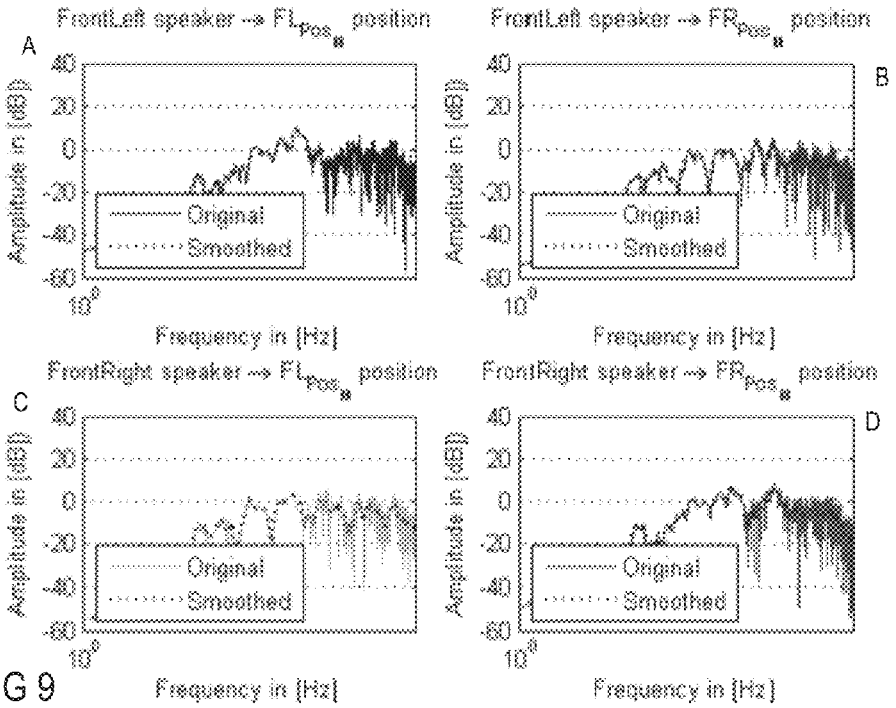
FIG. 9 is a diagram illustrating the magnitude frequency characteristic of the channels of an RIR matrix with no filtering applied.

FIG. 8 shows the impulse responses that result from unfiltered signals radiated by two groups of speakers, for example, a front left speaker group FLG with left loudspeakers 13 L and 14 L and a front right speaker group FRG with loudspeakers 13R and 14R, as received by the two microphones 15 L and 15 R at their positions on the left and right front seats, respectively. In particular, the diagrams of FIG. 8 depict (8A) the impulse response of the transfer channel from front left speaker group FLG to left microphone 15L, (8B) the impulse response of the transfer channels from front left speaker group FLG to right microphone 15R, (8C) the impulse response of the transfer channels from front right speaker group FRG to left microphone 15L, and (8D) the impulse response of the transfer channels from front right speaker group FRG to the right microphone 15R. FIG. 9 shows the magnitude frequency characteristic that corresponds to the impulse responses of FIG. 8. In particular, the diagrams of FIG. 9 depict (9A) the magnitude frequency characteristic of the transfer channel from front left speaker group FLG to left microphone 15L, (9B) the magnitude frequency characteristic of the transfer channels from front left speaker group FLG to right microphone 15R, (9C) the magnitude frequency characteristic of the transfer channels from front right speaker group FRG to left microphone 15L, and (9D) the magnitude frequency characteristic of the transfer channels from front right speaker group FRG to right microphone 15R. As can be seen, the signal radiated by the front left loudspeaker is received at the front left and front right positions, whereby these two reception signals have different spectral structures. The different reception signals are caused by signal paths. Accordingly, the signal radiated by the front right loudspeaker group is received at the front left and front right position, whereby these two reception signals also have different spectral structures due to different signal paths.

Figure 10:
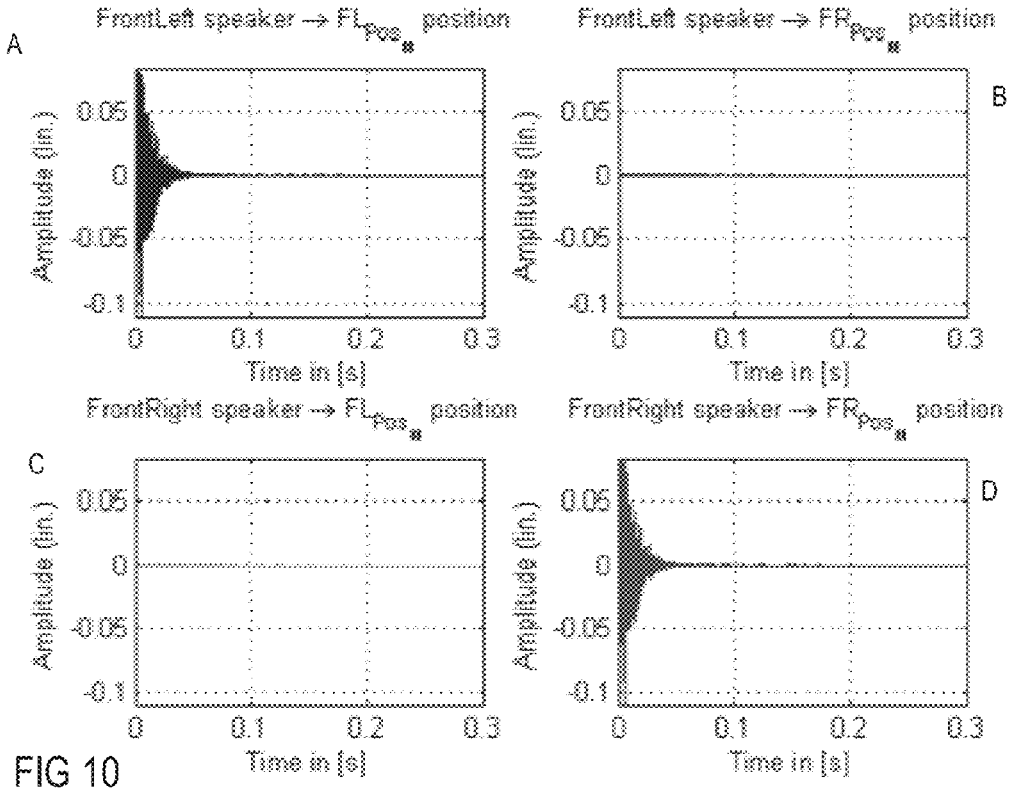
FIG. 10 is a diagram illustrating the impulse response of the channels of an RIR matrix when crosstalk attenuation filtering is applied.
Figure 11:
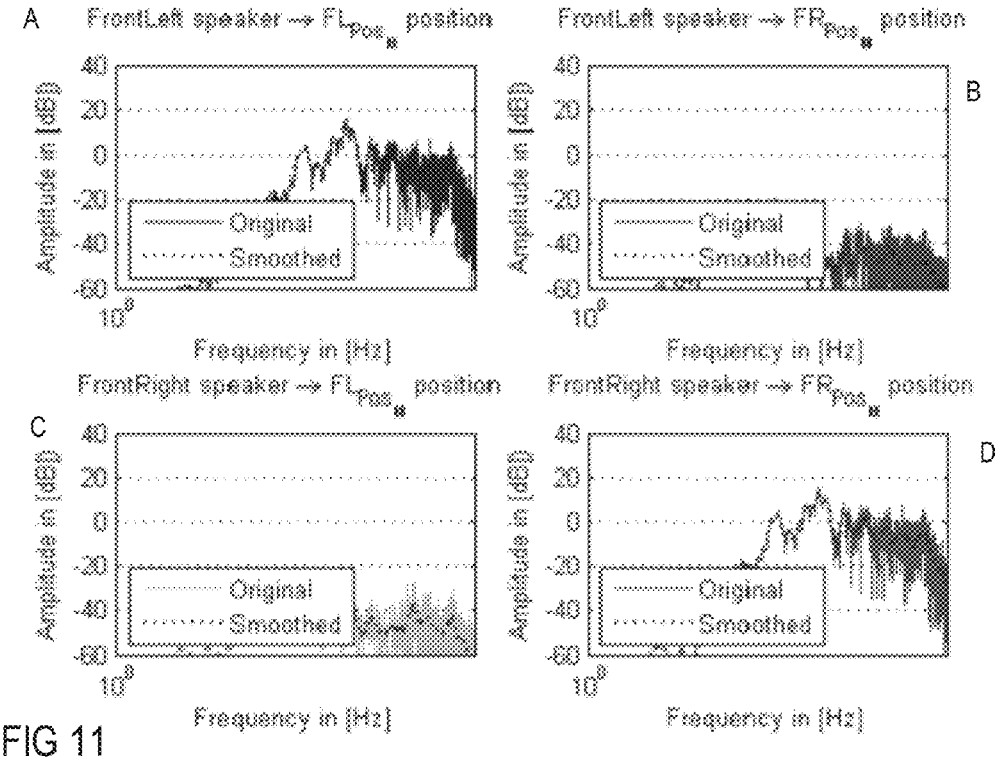
FIG. 11 is a diagram illustrating the magnitude frequency characteristic of the channels of an RIR matrix when crosstalk attenuation filtering is applied.

Impulse responses shown in FIG. 10 and magnitude frequency characteristics shown in FIG. 11 refer to the same situation as described above in connection with FIGS. 8 and 9 except that filtered signals instead of non-filtered signals are radiated by loudspeaker groups FLG and FRG. The filtered signals are the signals of FIGS. 8 and 9 filtered with an inverse filter C(jω), which is the filter of the adjoint matrix adj {H(jω)} so that C(jω)=adj {H(jω)}.

Figure 12:
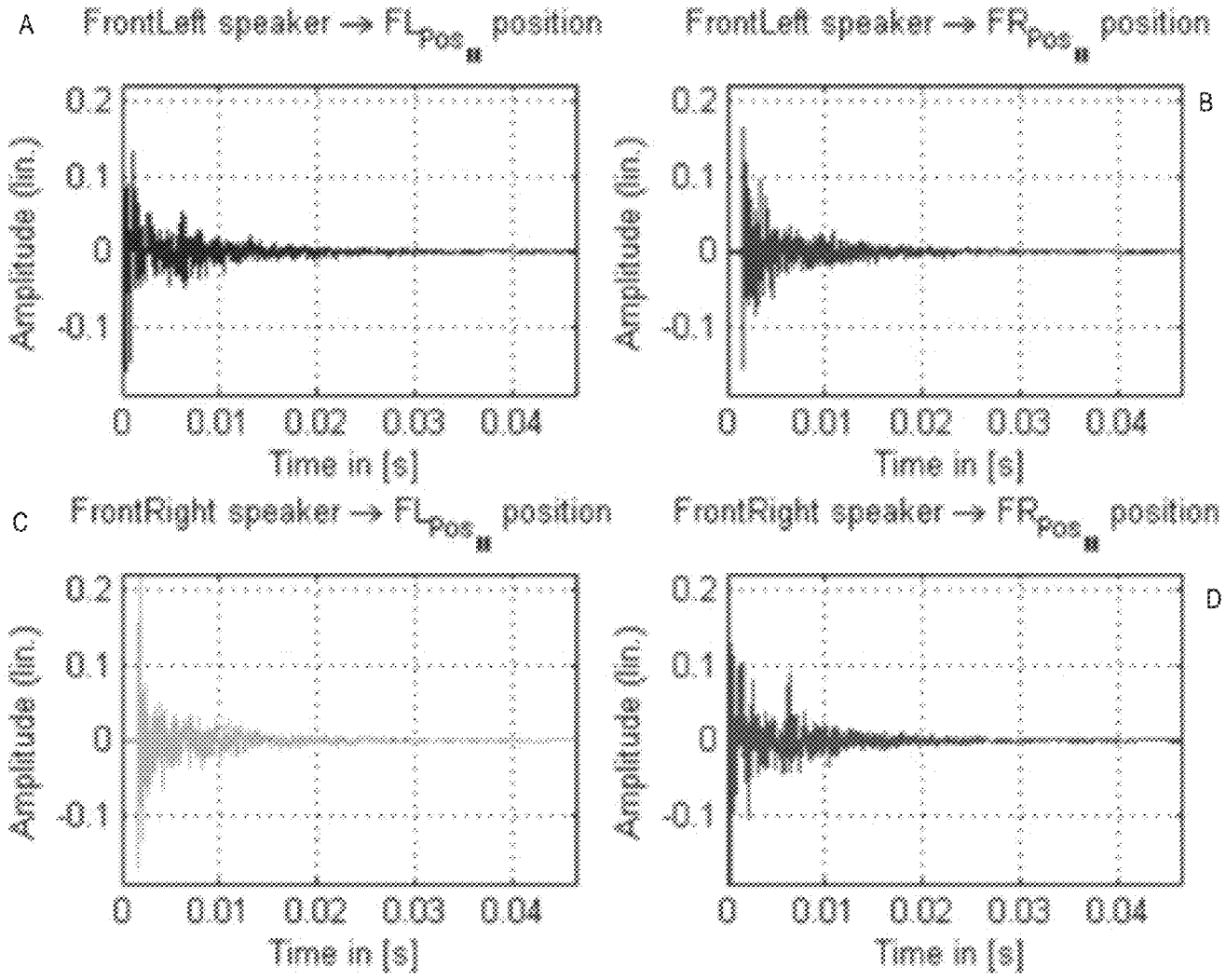
FIG. 12 is a diagram illustrating the impulse response of the crosstalk attenuation filter when the common delay is reduced.

If the filters of FIGS. 10 and 11 are extended to a length of t ≈46.4 ms, which is 2048 Taps at $f_s$=44.1 kHz, a crosstalk attenuation of 40 dB within the useful spectrum can be achieved, as shown in FIG. 11, which shows the magnitude frequency characteristic of the four room transfer channels of the RIR matrix filtered with C(jω)=adj {H(jω)}. In particular, a comparison of the magnitude frequency characteristics of FIGS. 9 and 11 exhibits that these filters with extended length cause a spectral deterioration. The compensation filter with the transfer function G(jω) compensates for this spectral deterioration. The impulse responses shown in FIGS. 10 and 12 are extracted to contain no common delays in all four channels. The efficiency of the filters in terms of crosstalk attenuation can be increased by eliminating the precursor coefficients $n_{BulkDelay}$, which model the common delay, from the impulse response and, thus, from the transfer function. All filters of FIG. 12 exhibit a causal behavior that declines exponentially, which is indicative of a minimum phase filter. The precursor coefficients $n_{BulkDelay}$ may be calculated as follows:

1. Calculate the maximum magnitude $cMax_{l,m}$ of all impulse responses $c_{l,m}$, where $cMax_{1,m}$ = $L\times M$ matrix including all maximum magnitudes = $\max|c_{1,m}|$ with $1=[1,\ldots,L]$ being a certain one of $L$ loudspeakers and $m=[1,\ldots,M]$ being a certain one of $M$ microphones, $c_{1,m}$ = impulse response between 1-*th* loudspeaker and *m*-*th* microphone = $(c_{1,m}[1], c_{1,m}[2], \ldots, c_{1,m}[K])$, and $K$ = length of the filter.

2. Calculate all thresholds $cTH_{l,m}$, where $cTH_{1,m}$ = an element of the 1-*th* line and *m*-*th* column of the $L\times M$ matrix that includes all thresholds = $cMax_{1,m}c_{TH}/100\%$, and $c_{TH}$ = Threshold in Percent.

3. Calculate the length of the precursor coefficients of impulse responses $nMat_{i,j}$, where $\underline{n}$ = a vector including the indices of the filter coefficients that meet the above specified requirements and where each of the elements $n$ of the vector $\underline{n}$ additionally fulfills the requirement $n\in\underline{n}\ \forall\ cTh_{1,m}[n]>cTH_{1,m}$, and $nMat_{i,j}$ = an element of the 1-*th* line and *m*-*th* column of the $L\times M$ matrix that includes the length of the precursor coefficients provided by $\underline{n}[0]$.

4. Calculate precursor coefficients $n_{BulkDelay}$, where $n_{BulkDelay}$ = minimum common delay time of all impulse responses = $\min\{nMat\}$, and $nMat$ = $L\times M$ matrix that includes the lengths of all precursor coefficients.

Figure 13:
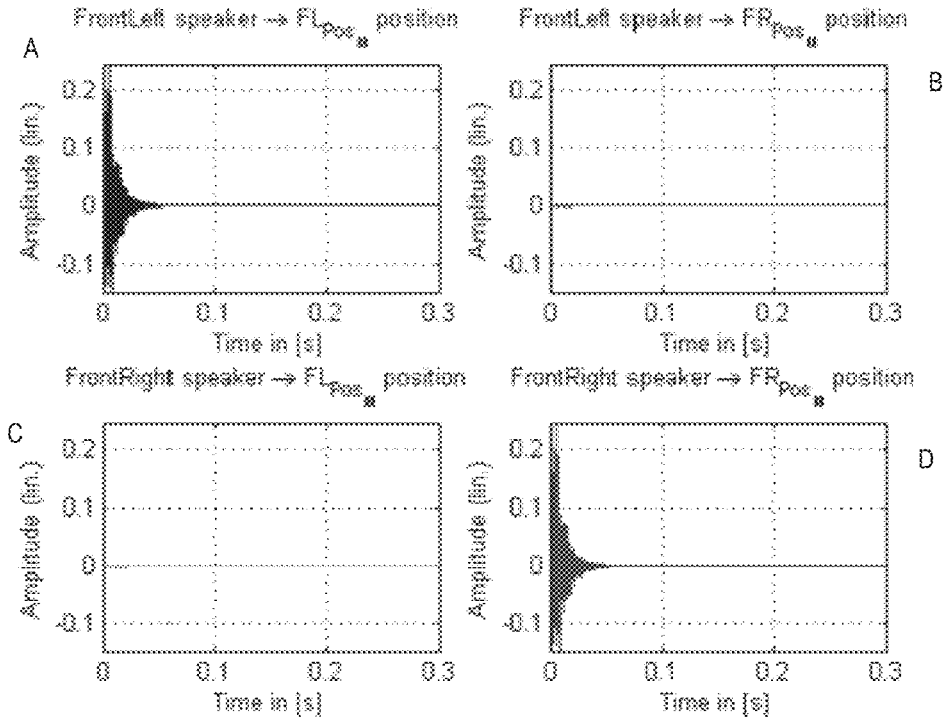
FIG. 13 is a diagram illustrating the impulse response of the channels of an RIR matrix when an complete inverse filtering is applied.
Figure 14:
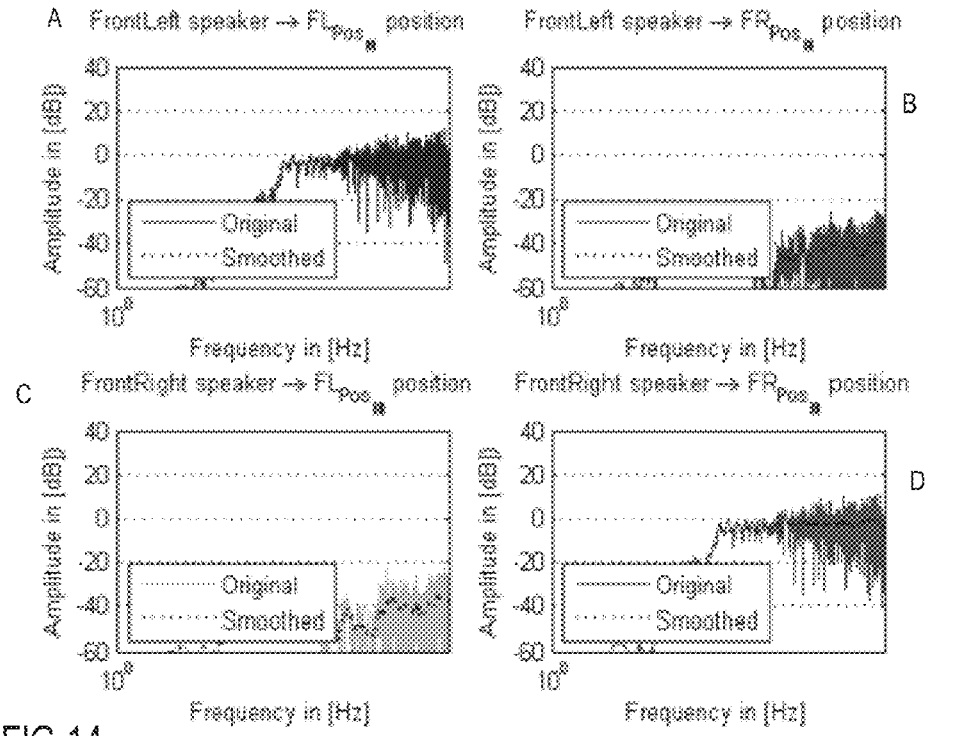
FIG. 14 is a diagram illustrating the magnitude frequency characteristic of the channels of an RIR matrix when a complete inverse filtering is applied.

Impulse responses shown in FIG. 13 and magnitude frequency characteristics shown in FIG. 14 refer to the same situation as described above in connection with FIGS. 8 and 9 except that as compensation filters with a transfer function G(jω), the inverse filters described herein are employed. A comparison of the impulse responses of FIGS. 10 and 13 exhibits that there are only very slight differences at the two listening (microphone) positions so that no audible artifacts are generated by the altered filters described herein. Furthermore, a comparison of the magnitude frequency characteristics of FIGS. 11 and 14 exhibits that these altered filters, whose magnitude frequency characteristic is shown in FIG. 14, compensate for the tonal variations that occur in the filters of FIG. 11 so that that no audible tonal variations are present at the two listening (microphone) positions. Here a flat target magnitude frequency response has been applied.

Figure 15:
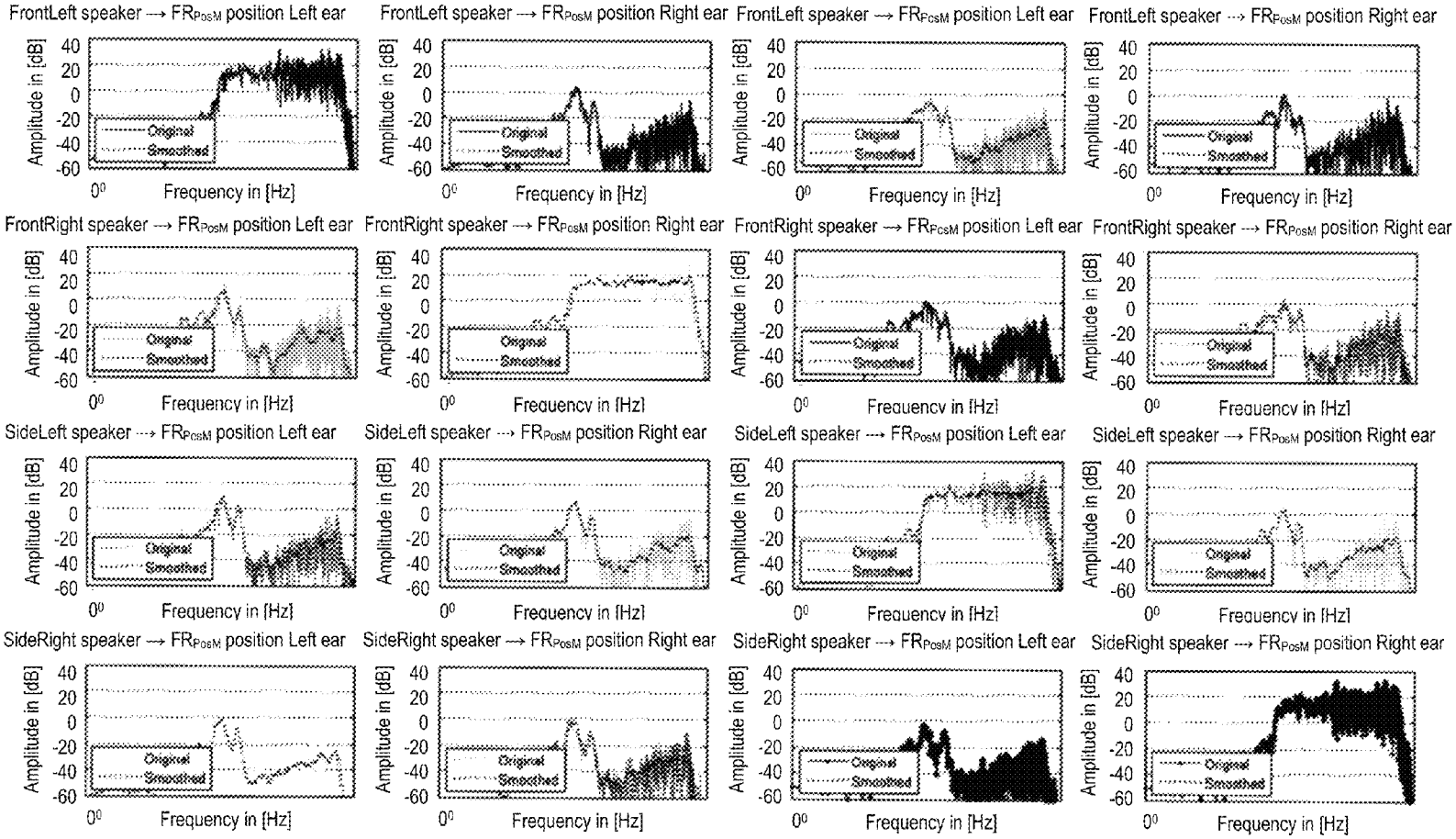
FIG. 15 is a diagram illustrating the magnitude frequency characteristic of the channels of an RIR matrix of a 4×4 system when a complete inverse filtering is applied.
Figure 16:
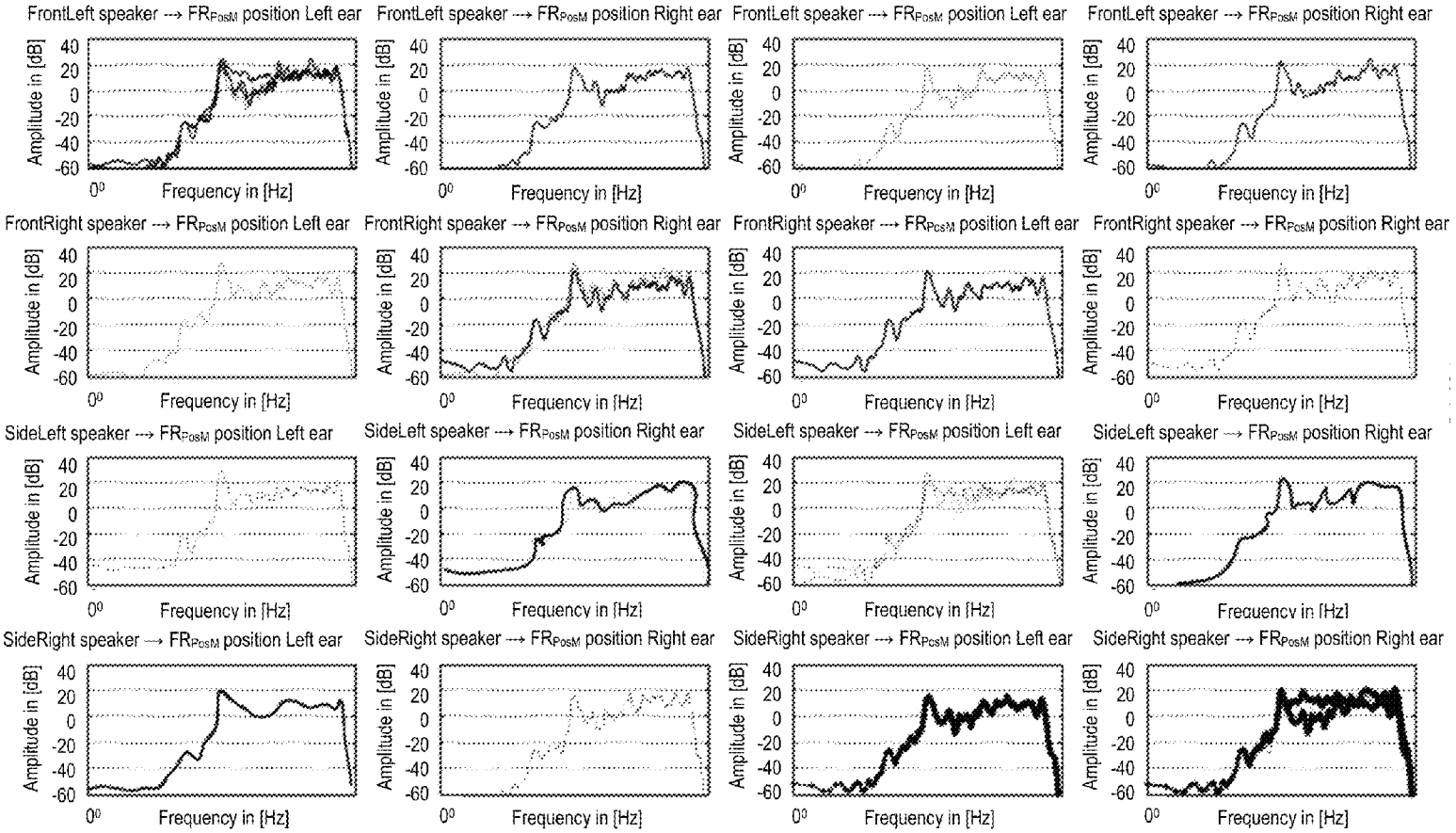
FIG. 16 is a diagram illustrating the magnitude frequency characteristic of a 4×4 system measured in a car cabin when complete inverse filtering is applied.

Referring again to FIG. 7, not only 2×2 systems, but also any square l×m systems can be realized using the filters described herein. For example, the system of FIG. 7 may be extended to a 4×4 system (or any other quadratic l×m system other than a 2×2 or 4×4 system). For this, additional rear channels may be included, i.e., rear left channel RL and rear right channel RR, which include midrange loudspeakers 16L and 16R and tweeter 17L and 17R, respectively. Midrange loudspeaker 16L and 16R and tweeters 17L and 17R are mounted in the left and right rear side doors, respectively. For the sake of accurate measurements additional microphones 18L and 18R are mounted in a position where average listeners in the rear seats would rest their heads. Still further loudspeakers 19 and 20 may be arranged on the dashboard and rear shelf of the car, respectively. The magnitude frequency response of the 4×4 system is shown in FIG. 15. The effect of the filter described herein is verified by real measurements in a car, as can be seen from the magnitude frequency characteristic of FIG. 16.

The spectral characteristic of the regularization parameter may correspond to the characteristics of the channel under investigation.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A sound system for acoustically reproducing at least two electrical audio signals and establishing at least two sound zones that are represented by individual patterns of reception sound signals, the system comprising:

a signal processing arrangement that is configured to process the at least two electrical audio signals to provide processed electrical audio signals; and at least two loudspeakers that are arranged at positions separate from each other, each configured to convert the processed electrical audio signals into corresponding acoustic audio signals; wherein each of the acoustic audio signals is transferred according to a room transfer matrix from each of the loudspeakers to each of the sound zones where they contribute to the reception sound signals;

processing of the at least two electrical audio signals comprises inverse filtering according to a filter matrix; and inverse filtering is configured to compensate for the room transfer matrix so that each one of the reception sound signals corresponds to one of the electrical audio.

2. The system of claim 1, where the reception sound signal comprise binaural signals.

3. The system of claim 1, further comprising at least one of one or more additional loud-speakers, one or more additional sound zones, and one or more additional listening positions.

4. The system of claim 1, where the filter matrix comprises regularized filters.

5. The system of claim 1, where the filter matrix comprises filters that are configured to exhibit a minimum common delay.

6. The system of claim 1, where the at least two loudspeakers are each part of a particular group of loudspeakers, each group comprising at least two loudspeakers.

7. The system of claim 6, where the inverse filtering is configured to compensate only for a minimum phase part of the room transfer matrix so that one of the reception sound signals corresponds to one of the electrical audio signals and another reception sound signal corresponds to another electrical audio signal.

8. A method for acoustically reproducing at least two electrical audio signals and establishing at least two sound zones that are represented by individual patterns of reception sound signals, the method comprising:

processing the at least two electrical audio signals to provide processed electrical audio signals; and converting the processed electrical audio signals into corresponding acoustic audio signals with at least two loudspeakers that are arranged at positions separate from each other;

transferring each of the acoustic audio signals according to a room transfer matrix from each of the loudspeakers to each of the sound zones where they contribute to the reception sound signals; and processing of the at least two electrical audio signals comprises inverse filtering according to a filter matrix; where inverse filtering is configured to compensate for the room transfer matrix so that each one of the reception sound signals corresponds to one of the electrical audio signals.

9. The method of claim 8, where the reception sound signal comprises binaural signals.

10. The method of claim 8, further comprising at least one of one or more additional loud-speakers, one or more additional sound zone, and one or more additional listening positions.

11. The method of claim 8, where the filter matrix comprises regularized filters.

12. The method of claim 8, where the filter matrix comprises filters that are configured to exhibit a minimum common delay.

13. The method of claim 8, where the at least two loudspeakers are each part of a particular group of loudspeakers, each group comprising at least two loudspeakers.

14. The method of claim 13, where the inverse filtering is configured to compensate only for a minimum phase part of the room transfer matrix so that one of the reception sound signals corresponds to one of the electrical audio signals and another reception sound signal corresponds to another electrical audio signal.

15. A method for acoustically reproducing at least two electrical audio signals and establishing at least two sound zones that are represented by individual patterns of reception sound signals, the method comprising:

processing the at least two electrical audio signals to provide processed electrical audio signals; and converting the processed electrical audio signals into corresponding acoustic audio signals with at least two loudspeakers that are arranged at positions separate from each other;

transferring each of the acoustic audio signals according to a room transfer matrix from each of the loudspeakers to each of the sound zones where they contribute to the reception sound signals;

processing of the at least two electrical audio signals comprises inverse filtering according to a filter matrix; and compensating for the room transfer matrix via inverse filtering so that each one of the reception sound signals corresponds to one of the electrical audio signals.

16. The method of claim 15, where the reception sound signal comprises binaural signals.

17. The method of claim 15, where the filter matrix comprises regularized filters.

18. The method of claim 15, where the filter matrix comprises filters that are configured to exhibit a minimum common delay.

19. The method of claim 15, where the at least two loudspeakers are each part of a particular group of loudspeakers, each group comprising at least two loudspeakers.

20. The method of claim 15, where compensating for the room transfer matrix via inverse filtering further comprises compensating only for a minimum phase part of the room transfer matrix so that one of the reception sound signals corresponds to one of the electrical audio signals and another reception sound signal corresponds to another electrical audio signal.

* * * * *